US005800281A

United States Patent [19]

Gilbert

[11] Patent Number: 5,800,281

[45] **Date of Patent: *Sep. 1, 1998**

[54] GOLF CLUB SOLE CONFIGURATION

[75] Inventor: Peter J. Gilbert, Vista, Calif.

[73] Assignee: Acushnet Company, Fairhaven, Mass.

[ * ] Notice: The term of this patent shall not extend beyond the expiration date of Pat. No. 5,549,296.

[21] Appl. No.: 702,069

[22] Filed: Aug. 23, 1996

Related U.S. Application Data

[63] Continuation-in-part of Ser. No. 402,251, Mar. 10, 1995, Pat. No. 5,549,296.

[51] Int. Cl.[6] ..... A63B 53/04

[52] U.S. Cl. ..... 473/287; 473/328; 473/350

[58] Field of Search ..... 473/287, 290, 473/324, 328, 344, 350

[56] References Cited

U.S. PATENT DOCUMENTS

| | | | |
|---|---|---|---|
| D. 332,812 | 1/1993 | Solheim . | |
| D. 364,206 | 11/1995 | Schmidt et al. . | |
| 2,705,147 | 3/1955 | Winter . | |
| 3,897,065 | 7/1975 | Solheim . | |
| 4,671,513 | 6/1987 | Swanson . | |
| 4,854,580 | 8/1989 | Kobayashi . | |
| 5,301,941 | 4/1994 | Allen . | |
| 5,301,944 | 4/1994 | Koehler . | |
| 5,312,105 | 5/1994 | Cleveland . | |
| 5,419,556 | 5/1995 | Take | 473/328 |
| 5,423,534 | 6/1995 | Solheim . | |
| 5,480,152 | 1/1996 | Schmidt et al. | 473/328 |

*Primary Examiner*—William M. Pierce
*Attorney, Agent, or Firm*—Pennie & Edmonds LLP

[57] ABSTRACT

A golf club or set of golf clubs include a sole having three surfaces: an entrance surface, a bounce surface and a trailing surface. The bounce surface is angled from the ground with a bounce angle and has a pair of cavities that are aligned with the sole of the golf club.

21 Claims, 7 Drawing Sheets

GOLF CLUB SOLE CONFIGURATION

This is a Continuation-In-Part application from patent application Ser. No. 08/402,251 filed on Mar. 10 1995 now U.S. Pat. No. 5,549,296.

FIELD OF THE INVENTION

The present invention relates to a set of golf clubs, and more particularly, to a set of golf clubs with a sole configuration that provides optimum performance for each club in the set.

BACKGROUND OF THE INVENTION

Prior golf clubs have included a variety of flange or sole configurations. The purpose of the sole is to provide a surface to rest the club against the ground. Therefore, the majority of the prior art soles have been flat to correspond to the contour of the ground.

To avoid substantial digging by the club's leading edge during the down swing, particularly with the high lofted clubs, most prior art clubs include a radius along the leading edge. The radius along the leading edge avoids a sharp edge that would otherwise allow the club to dig into the ground as the club impacts the ball.

SUMMARY OF THE INVENTION

Broadly, the present invention comprises a golf club having a flange or sole configuration comprising three (3) surfaces: an entrance surface, a bounce surface, and a trailing surface. The bounce surface has a pair of cavities that are axially aligned with a leading edge of the golf club.

The entrance surface is a narrow surface adjacent to the lower edge of the club face or the leading edge of the striking surface. The entrance surface is angled from the ground by a positive bounce angle. Generally, it is preferred that the positive bounce angle increase for the amount of loft in the club. Therefore, the long irons that have little loft should have a smaller positive bounce angle and the short irons that have substantially more loft should have a larger positive bounce angle. Moreover, the width of the entrance surface preferably increases in relation to the amount of loft in the club.

The second surface is a bounce surface, or the sole of the club head, which is located between and connects the entrance surface to the trailing surface. Between the bounce surface and the toe of the club is a first cavity and between the bounce surface and the heel of the club is a second cavity. The bounce surface and the cavities are essentially axially aligned to be parallel to the leading edge of the striking surface.

The bounce surface is also angled from the ground by a bounce angle. It is preferred that the bounce angle increases from zero degrees to a positive angle according to the amount of loft in the club. Therefore, the long irons each have a bounce surface that is essentially parallel to the ground. The middle irons and the short irons have a positive bounce angle that increases according to the amount of loft in the club.

The third surface is the trailing surface, which is angled from the ground by a relief angle. The relief angle is preferably large enough to allow the club face to be opened without appreciably changing the height of the lower edge of the club face.

In an alternative embodiment, the bounce surface is also angled from the ground by a bounce angle. The bounce angle increases from a negative angle to a positive angle according to the amount of loft in the club. Therefore, the long irons that have little loft have a negative bounce angle, the middle irons that have a medium loft have a bounce angle and bounce surface that are essentially parallel to the ground, and the short irons that have relatively large loft angles have a positive bounce angle.

It is a feature that a plurality of clubs in a set of clubs have a flange or sole as set forth above. More particularly, it is a feature of the present invention to have a plurality of clubs designed to provide optimum performance for each club.

It is a further feature of the invention that the lower edge, or the leading edge of the striking surface, varies in height from the ground throughout a set of irons. The leading edge height is a function of the width of the entrance surface, the bounce surface, and the angles of the positive bounce angle and the bounce angle. These dimensions are preferably designed such that the leading edge height progressively increases with the club loft within a set.

It is a further feature of the present invention wherein the bounce surface provides minimum resistance against the ground as the club head is brought back in relation to the ground during the back swing.

DESCRIPTION OF THE PREFERRED EMBODIMENT

Figure 1:
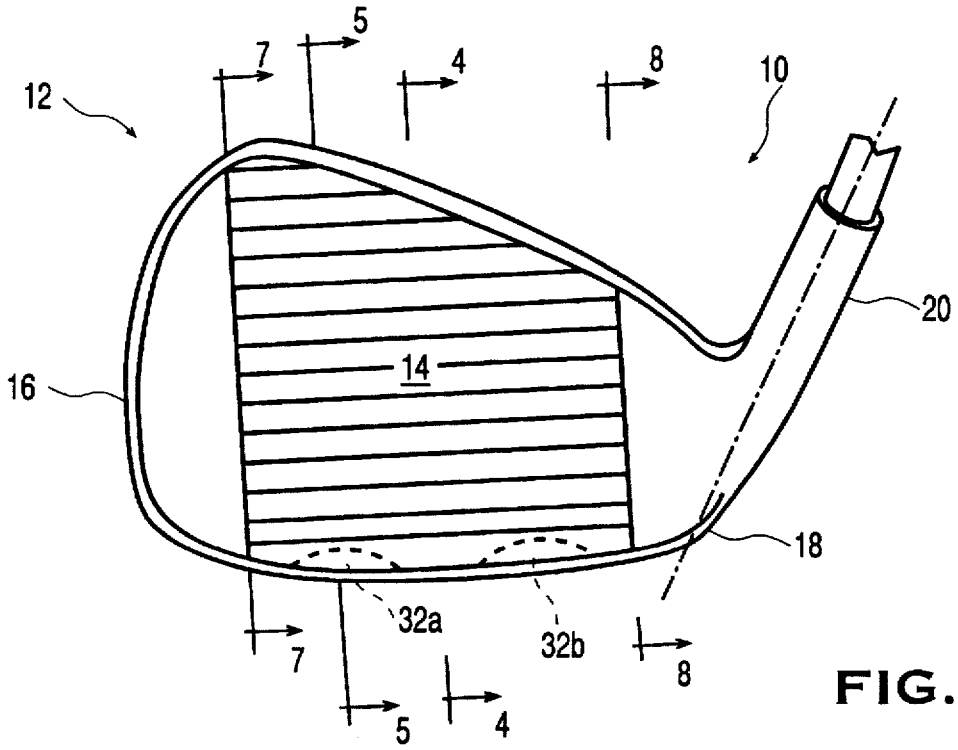
FIG. 1 is a front elevational view of a short iron golf club head of the present invention having three (3) sole related surfaces.

Referring to FIGS. 1–8, a high lofted club, such as a 9-iron, includes three (3) surfaces on the club flange or sole to accomplish proper engagement of the club with the ground during address and movement of the club head during the swing. The sole of the club has a pair of cavities that are aligned to be parallel to the leading edge of the strike surface of the club. The club 10 includes a body 12 with a striking face 14, a leading edge or lower edge 14*a*, a toe 16, a heel 18, a hosel 20, a sole 22, and a rear face 24. As described below, the present invention is not limited to one club, but may be used for all clubs in a set, which generally consists of a three (3) iron through a sand wedge, but may include a one (1) iron through a sand wedge and a lob wedge.

The sole 22 or flange of body 12 has three surfaces, a first surface 26, a second surface 28, and a third surface 30. The second surface 28 is positioned between the first surface 26 and the third surface 30.

The first surface 26 of sole 22 is an entrance surface that is adjacent to the leading edge 14*a* of the striking face 14. The first surface 26 has a positive bounce angle $\Theta_1$, and extends a distance $d_5$ from the leading edge 14*a*. Preferably, the entrance surface 26 extends from the toe 16 to the heel 18 and is relatively narrow with a width of the surface between approximately 0.1 and 0.3 inch.

The second surface 28 of sole 22 is the bounce surface, which is located between the entrance surface 26 and the trailing surface 30. The bounce surface 28 extends from and connects the entrance surface 26 to the trailing surface 30. A first cavity portion 32*a* is located between the bounce surface 28 and the toe 16 of the club and between the entrance surface 26 and the trailing surface 30. A second cavity portion 32*b* is located between the bounce surface 28 and the heel 18 of the club and between the entrance surface 26 and the trailing surface 30.

The bounce surface 28 is also angled from the ground by bounce angle $\Theta_2$ and extends the distance $d_{10}$ from the center of the leading edge 14*a* to the center of the bounce surface back edge, or the contact point CP, which is where the bounce surface 28 intersects with the sole trailing surface 30. Preferably, the bounce angle $\Theta_2$ is relatively small, approximately zero degrees for low lofted clubs and substantially larger for high lofted clubs. It is preferred that the bounce angle increases from zero degrees to a positive angle according to the amount of loft in the club. Therefore, the long irons each have a bounce surface that is essentially parallel to the ground. The middle irons and the short irons have a positive bounce angle that increases according to the amount of loft in the club.

The third surface 30, or the trailing surface of sole 22, is adjacent to the rear face 24 and has a negative relief angle $\Theta_3$. The negative relief angle $\Theta_3$ is designated as a negative angle. Preferably, the negative relief angle $\Theta_3$ is equal to or less than about negative 15 degrees so that the club will not rest on the trailing surface 30 during address and so that the club will not catch the ground during the take away of the club from address during the back swing.

Figure 4:
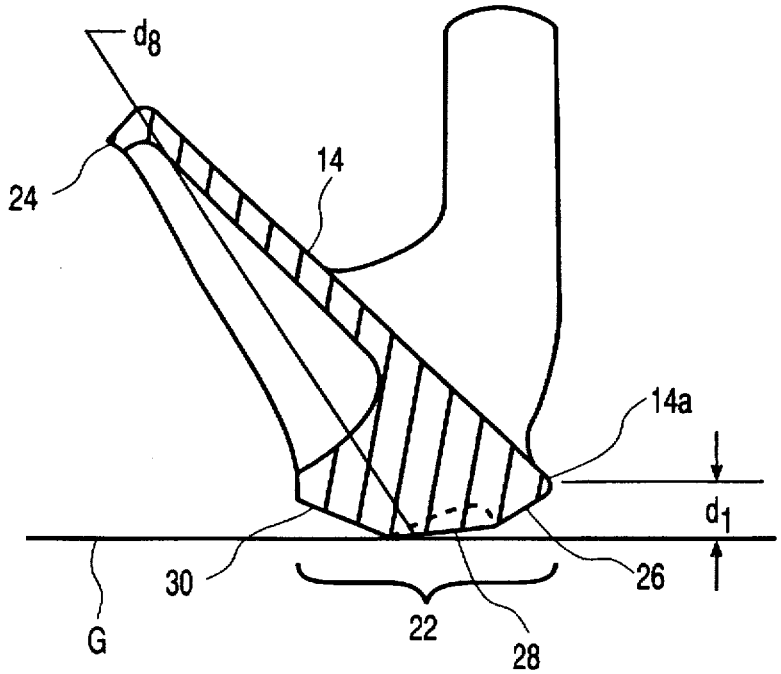
FIG. 4 is a cross-sectional view taken along line 4—4 of FIG. 1 showing the short iron golf club head of the present invention with large loft.
Figure 5:
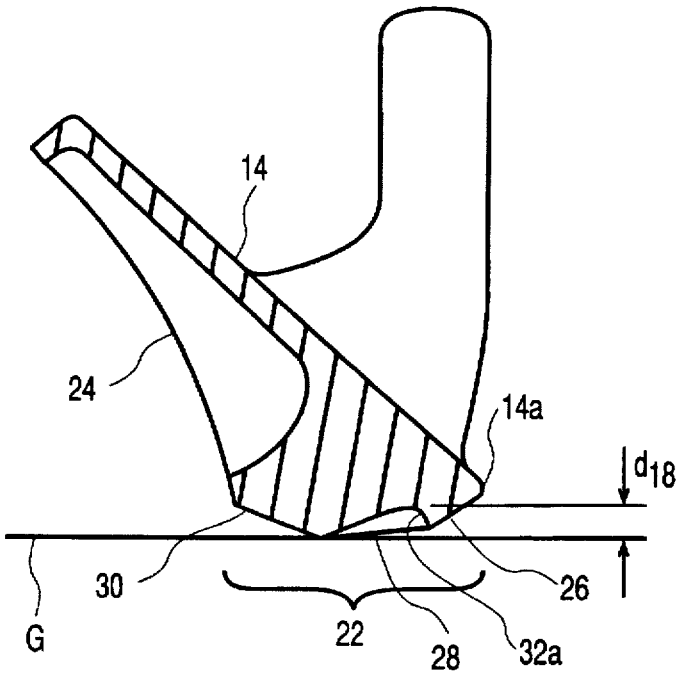
FIG. 5 is a cross-sectional view taken along line 5—5 of FIG. 1 showing the golf club head of the present invention.

Also shown in FIG. 4 is the height dimension $d_1$, from the ground to the leading edge 14*a* of the club face. The leading edge height $d_1$, is smaller in irons with the least loft and larger in the irons with most loft. Preferably, the leading edge height $d_1$, is progressively larger within a set as shown in Table I below.

Figure 6:
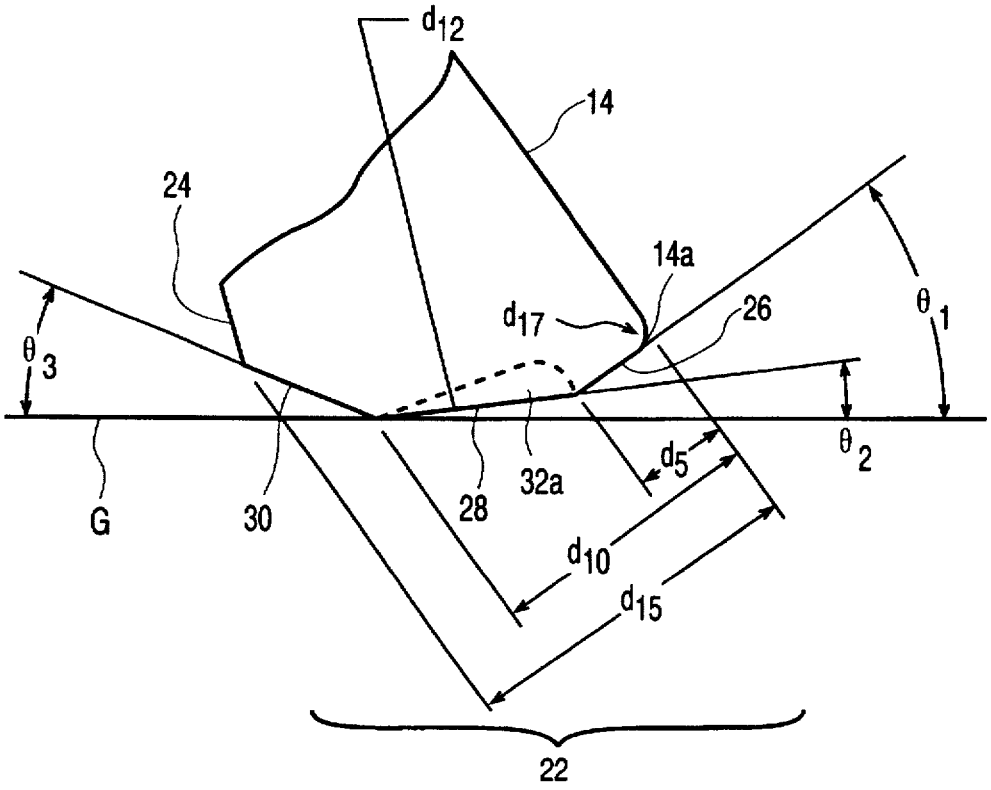
FIG. 6 is an enlarged partial view of FIG. 4 showing the golf club head of the present invention with large loft resting on the ground.
Figure 7:
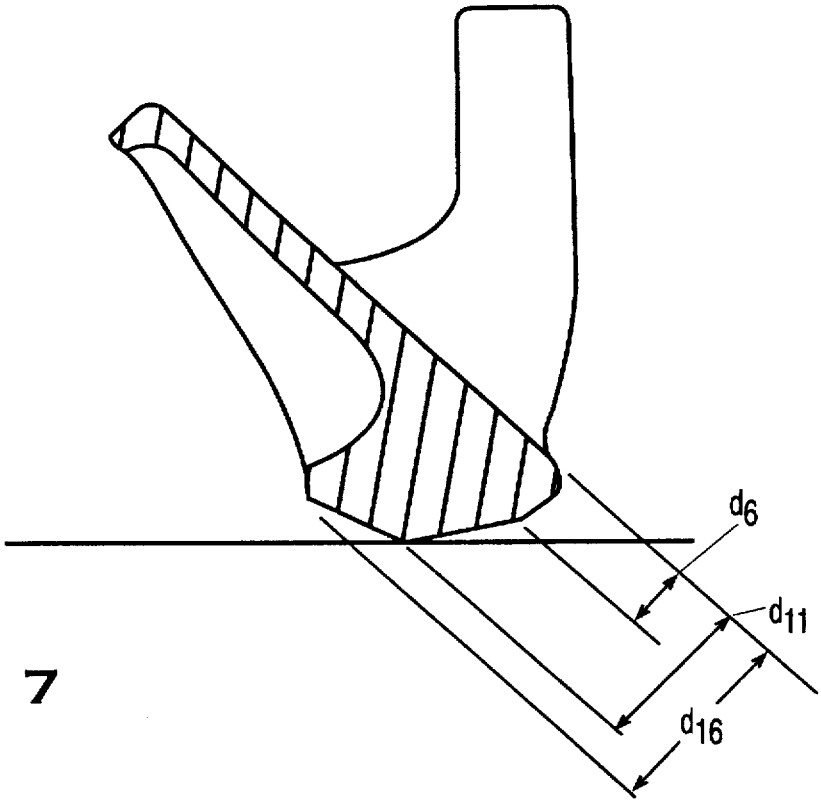
FIG. 7 is a cross-sectional view taken along line 7—7 of FIG. 1 showing the golf club head of the present invention.
Figure 8:
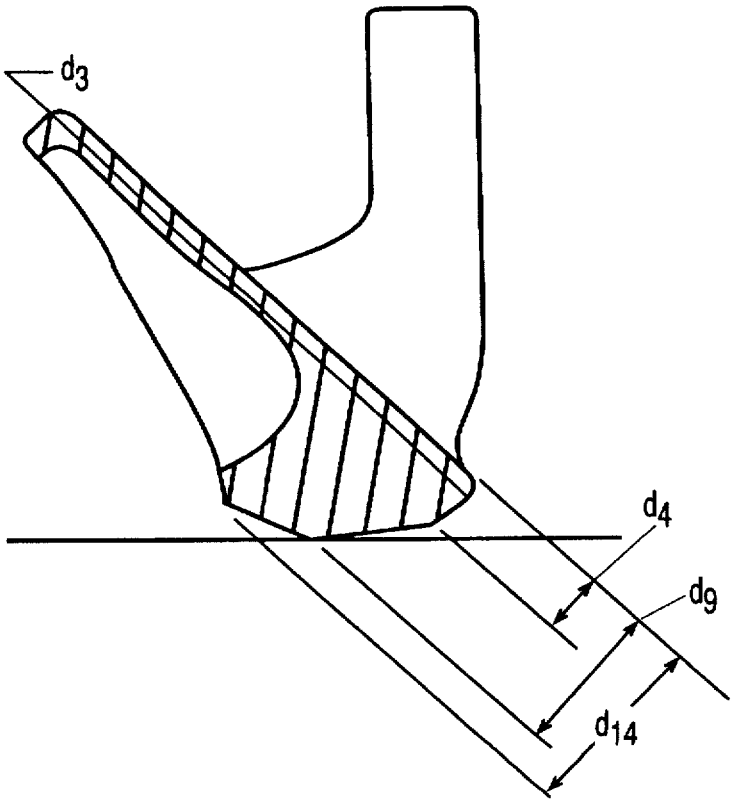
FIG. 8 is a cross-sectional view taken along line 8—8 of FIG. 1 showing the golf club head of the present invention.
Figure 9:
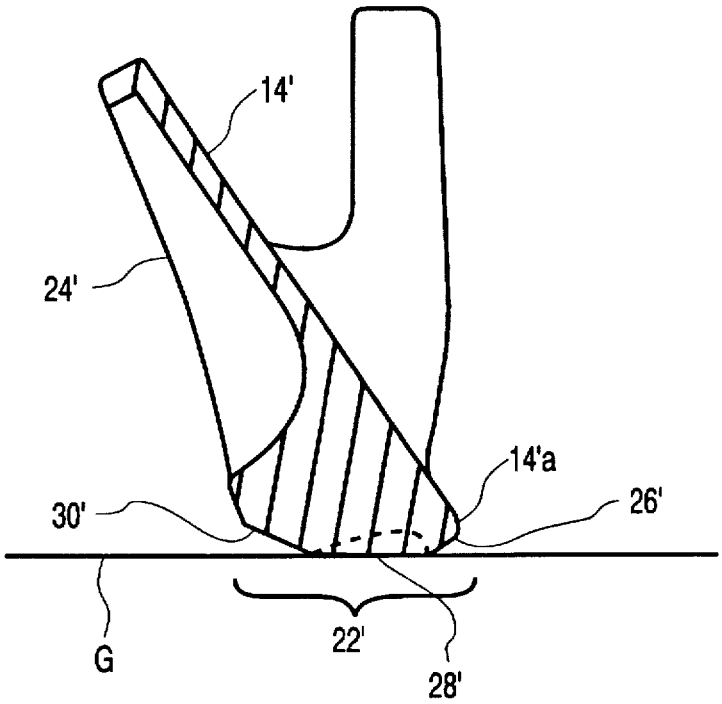
FIG. 9 is a cross-sectional view similar to FIG. 4, showing a middle iron golf club head of the present invention with medium loft resting on the ground.
Figure 10:
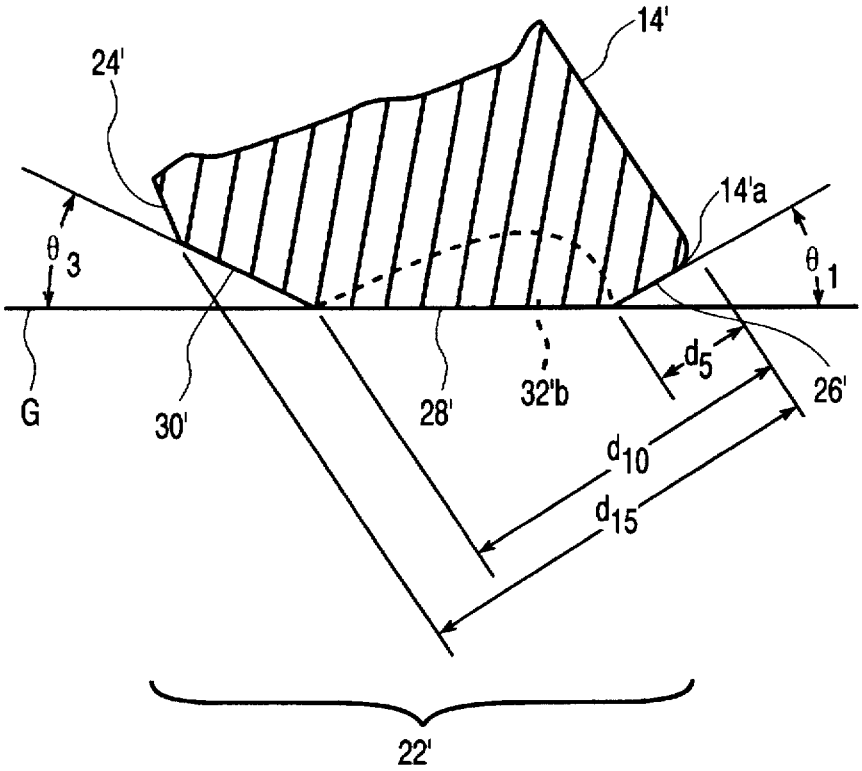
FIG. 10 is an enlarged partial view of FIG. 9 showing the middle iron golf club head of the present invention with medium loft resting on the ground.

Referring to Table I and FIG. 6, preferably both the positive bounce angle $\Theta_1$ and the bounce angle $\Theta_2$ progressively increase with the club loft within a set of irons. Therefore, the angles remain either the same or increase from one club to the next going from the low lofted clubs to the high lofted clubs. Similarly, the width of the entrance surface 26 should be larger for the high lofted clubs. The larger bounce angles $\Theta_1$ and $\Theta_2$ and the greater widths of the entrance surface 26 in the high lofted clubs will help prevent digging into the ground during "fat" shots, while the small bounce angle $\Theta_1$ and a negative bounce angle $\Theta_2$, or the lack of a bounce angle $\Theta_2$ in the low lofted clubs, allow the player to strike the golf ball more cleanly with a minimum amount of drag of the club head against the ground.

It will be appreciated by those skilled in the art that the numbers presented in Table I are preferred numbers. Moreover, the bounce angles $\Theta_1$ and $\Theta_2$ and surface widths $d_5$ and $d^{10}$ may be varied for the type of player and the playing conditions. For instance, the bounce angles $\Theta_1$ and $\Theta_2$ and surface widths $d_5$ and $d_{10}$ should generally be greater for a high handicap player or for playing in wetter, softer conditions. Thus, the club or set of clubs may have customized sole configurations and dimensions for the player and/or the playing conditions.

TABLE I

| Let | Description | Units | 1 | 2 | 3 | 4 | 5 | 6 | 7 | 8 | 9 | PW | W | SW | LW |
|---|---|---|---|---|---|---|---|---|---|---|---|---|---|---|---|
| $d_1$ | Leading Edge Height | In. | .118 | .125 | .126 | .147 | .148 | .156 | .158 | .164 | .186 | .217 | .263 | .328 | .306 |
| $\theta_1$ | Positive Bounce Angle | Deg | 30.0 | 30.0 | 30.0 | 35.0 | 35.0 | 35.0 | 35.0 | 40.0 | 40.0 | 40.0 | 40.0 | 45.0 | 45.0 |
| $d_3$ | Heal-Toe Radius L. Edge | In. | 10.0 | 10.0 | 10.0 | 10.0 | 10.0 | 10.0 | 10.0 | 9.0 | 9.0 | 9.0 | 9.0 | 9.0 | 9.0 |
| $d_4$ | Entrance Length Heel | In. | 0.150 | 0.150 | 0.150 | 0.150 | 0.150 | 0.150 | 0.150 | 0.150 | 0.150 | 0.150 | 0.150 | 0.150 | 0.150 |
| $d_5$ | Entrance Length Center | In. | 0.200 | 0.200 | 0.200 | 0.200 | 0.210 | 0.210 | 0.210 | 0.220 | 0.220 | 0.220 | 0.220 | 0.220 | 0.220 |
| $d_6$ | Entrance Length Toe | In. | 0.150 | 0.150 | 0.150 | 0.150 | 0.150 | 0.150 | 0.150 | 0.150 | 0.150 | 0.150 | 0.150 | 0.150 | 0.150 |
| $\theta_2$ | Bounce Angle | Deg | 0.0 | 0.0 | 0.0 | 1.0 | 1.0 | 2.0 | 3.0 | 4.0 | 5.0 | 7.0 | 10.0 | 16.0 | 18.0 |
| $d_8$ | Heal-Toe Radius Center | In. | 7.500 | 7.500 | 7.500 | 7.500 | 7.500 | 7.500 | 7.500 | 7.500 | 7.500 | 7.000 | 7.000 | 6.000 | 6.000 |

TABLE I-continued

| Let | Description | Units | 1 | 2 | 3 | 4 | 5 | 6 | 7 | 8 | 9 | PW | W | SW | LW |
|---|---|---|---|---|---|---|---|---|---|---|---|---|---|---|---|
| $d_9$ | Bounce Length Heel | In. | 0.380 | 0.380 | 0.380 | 0.380 | 0.380 | 0.380 | 0.380 | 0.380 | 0.380 | 0.380 | 0.340 | 0.340 | 0.340 |
| $d_{10}$ | Bounce Length Center | In. | 0.620 | 0.620 | 0.620 | 0.620 | 0.620 | 0.620 | 0.620 | 0.620 | 0.620 | 0.560 | 0.540 | 0.580 | 0.520 |
| $d_{11}$ | Bounce Toe Length | In. | 0.450 | 0.450 | 0.450 | 0.450 | 0.450 | 0.450 | 0.450 | 0.450 | 0.450 | 0.450 | 0.420 | 0.420 | 0.420 |
| $d_{12}$ | Crown Radius Front-Back | In. | 0.000 | 0.000 | 0.000 | 0.000 | 0.000 | 0.000 | 0.000 | 0.000 | 0.000 | 0.000 | 0.000 | 0.000 | 0.000 |
| $\theta_3$ | Trailing Angle | Deg | −15.0 | −15.0 | −15.0 | −15.0 | −15.0 | −15.0 | −15.0 | −20.0 | −20.0 | −25.0 | −25.0 | −25.0 | −25.0 |
| $d_{14}$ | Trailing Length Heel | In. | 0.450 | 0.450 | 0.450 | 0.450 | 0.450 | 0.450 | 0.450 | 0.450 | 0.450 | 0.450 | 0.420 | 0.420 | 0.420 |
| $d_{15}$ | Trailing Length Center | In. | 0.680 | 0.680 | 0.700 | 0.700 | 0.730 | 0.730 | 0.750 | 0.660 | 0.650 | 0.640 | 0.640 | 0.710 | 0.710 |
| $d_{16}$ | Trailing Length Toe | In. | 0.770 | 0.770 | 0.790 | 0.790 | 0.790 | 0.800 | 0.810 | 0.770 | 0.720 | 0.710 | 0.710 | 0.730 | 0.730 |
| $d_{17}$ | Leading Edge Radius | In. | 0.080 | 0.080 | 0.080 | 0.080 | 0.080 | 0.080 | 0.080 | 0.080 | 0.080 | 0.080 | 0.080 | 0.080 | 0.080 |
| $d_{18}$ | Step Height | In. | 0.025 | 0.025 | 0.025 | 0.025 | 0.025 | 0.025 | 0.025 | 0.025 | 0.040 | 0.040 | 0.040 | 0.040 | 0.040 |
| $d_{19}$ | Tail Radius | In. | 0.188 | 0.188 | 0.188 | 0.188 | 0.188 | 0.188 | 0.188 | 0.188 | 0.188 | 0.188 | 0.188 | 0.188 | 0.188 |

Figure 2:
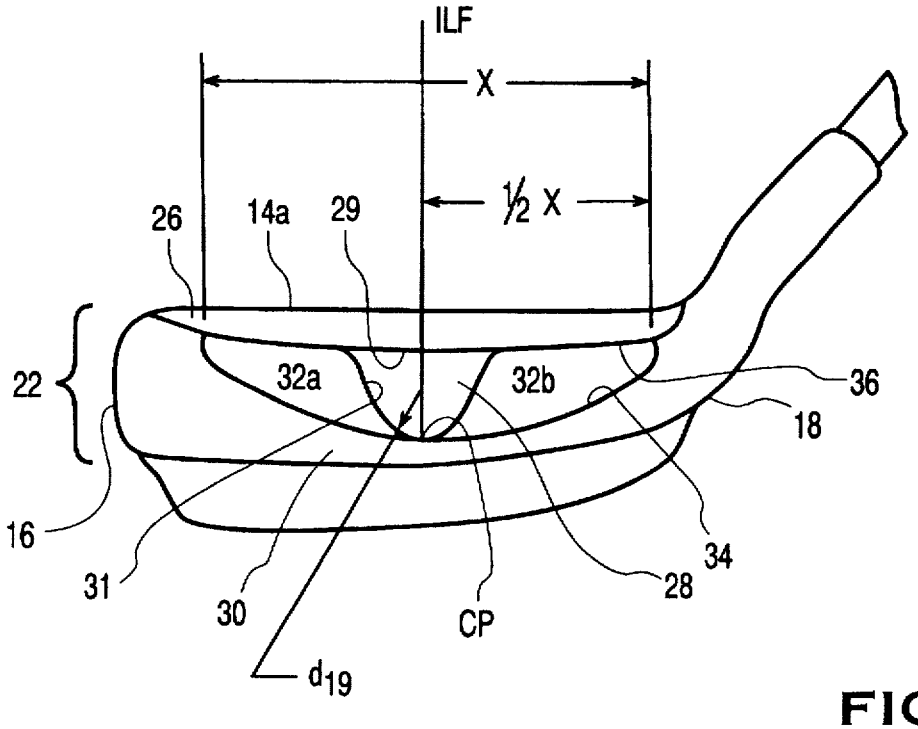
FIG. 2 is an underside view of the golf club head of the present invention showing the golf club head square at address.

Referring to FIG. 2, in the preferred embodiment, the bounce surface 28 has a parabolic shape, which is defined by the bounce surface 28 and the adjacent sole cavities 32*a* and 32*b*. The sole surfaces 26, 28 and 30 intersect to define an arcuate forward border 29 that is adjacent to and generally convex in shape in relation to the entrance surface 26. An aft arcuate border 34 is adjacent to and generally concave in shape in relation to the trailing surface 30. An aft bounce surface border 31 extends from the front arcuate border 29 to the aft arcuate border 34 and forms a contact point CP where the aft bounce surface border 31 meets the aft arcuate border 34. The apex of the parabolic shaped bounce surface 28 is located at the lowest point of the iron, or the contact point CP, on the aft border 34. When the club head 10 is held and supported by the player, the club head body 12 theoretically would touch a smooth plane (the ground) at the contact point CP. The contact point CP is in the center of the aft arcuate border 34. Therefore, as shown in FIG. 3, the length of the aft arcuate border 34 between the toe 16 and the heel 18 is a distance X and the contact point CP is at ½x from the heel 18.

Figure 3:
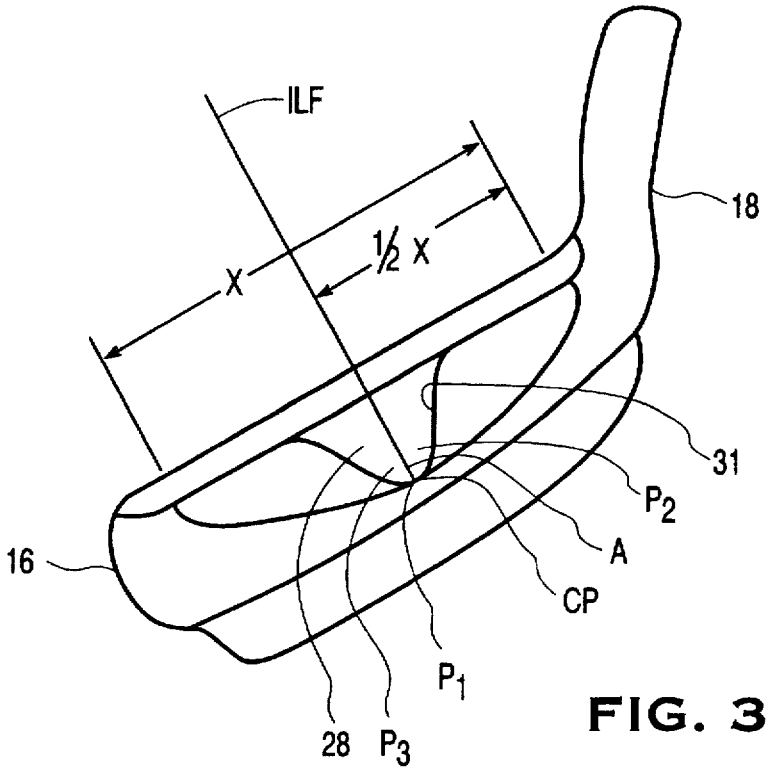
FIG. 3 is an underside view of the golf club head of the present invention with the golf club head open at address.

As shown in FIG. 3, the club head 10 is shown in the open position with the bounce surface 28 engaging the ground at the contact point CP. The ground contact point CP remains at the same point CP in the middle of the club head as when the club face is in the square position, as shown in FIG. 2. This advantage greatly increases the versatility of the club head by substantially keeping the contact point CP in the middle and keeping the leading edge height constant.

When the club of the present invention is in use, the sole 22 typically engages uneven or soft ground, including grass, along a club surface area A within the bounce surface 28. The pressure exerted by the club head 10 against the ground varies with the weight of the club and the player's technique. The pressures in area A of the bounce surface 28 of the preferred embodiment of the present invention include pressure $P_1$ in the center of A, which is larger than pressures $P_2$ and $P_3$ at the ends of area A towards the toe 16 and the heel 18, respectively. The vertical relief in the toe 16 and the heel 18 are such that the ground pressure decreases away from the center or contact point CP of the bounce surface 28. When the player allows the club body 12 to rest partially supported and readied for swinging, $P_1$ at the contact point CP will be four (4) to five (5) times greater than pressures $P_2$ and $P_3$, which are along the outer edges of the contact area toward the toe 16 and the heel 18. The pressure differential is accomplished because the angle $\Theta_2$ and the aft bounce surface border 31 of the bounce surface 28 create a vertical relief in the bounce surface 28 toward the toe 16 and the heel 18. The vertical relief results in the ends of the contact area along the aft bounce surface border 31 to be vertically closer to the player than the center CP of the bounce surface 28 and, therefore, the ends of the contact area do not contact the ground with the same pressure as the center CP. In effect, the CP acts as a pivot point so that the club may be opened or closed depending on the shot desired.

Figure 11:
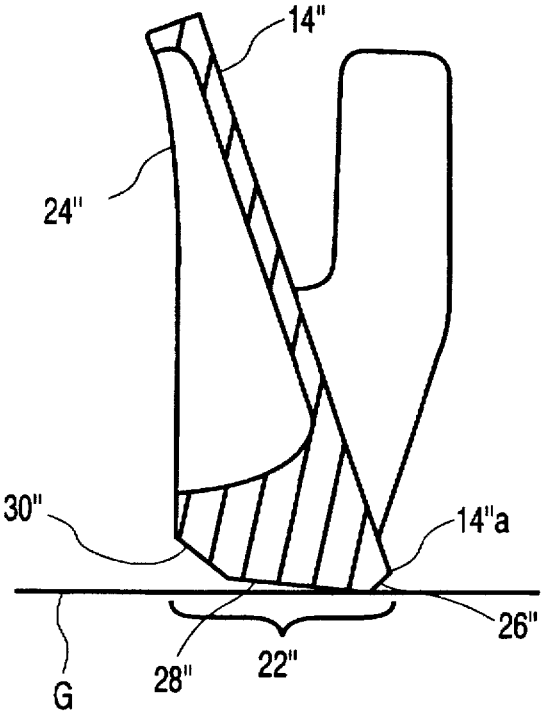
FIG. 11 is a cross-sectional view similar to FIG. 4, showing an alternative embodiment of a long iron golf club head of the present invention with little loft resting on the ground.
Figure 12:
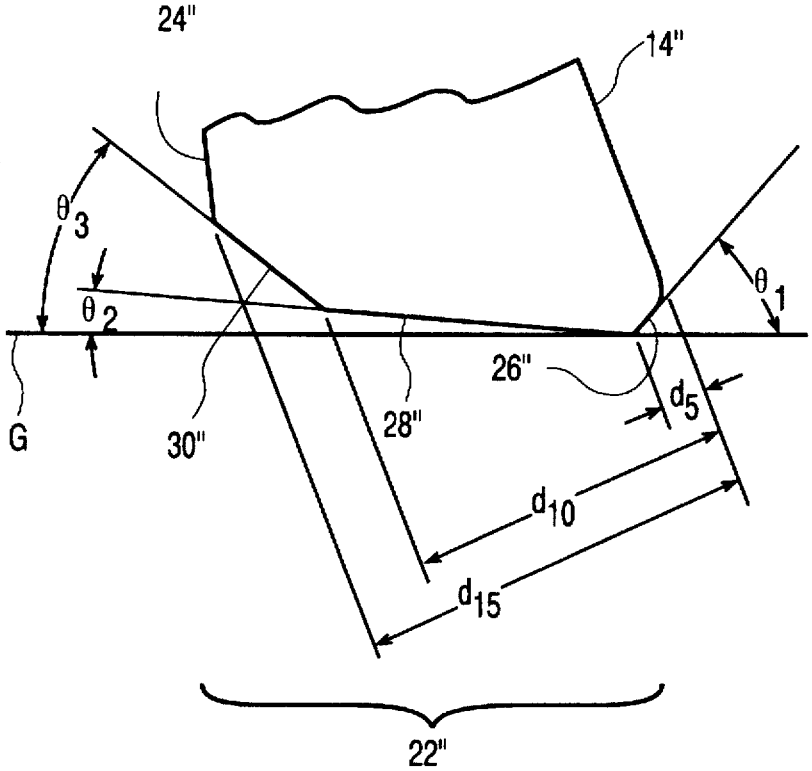
FIG. 12 is an enlarged partial view of FIG. 11 showing the long iron golf club head of the present invention with little loft resting on the ground.

An alternative embodiment is shown in FIGS. 11 and 12, which is similar to the embodiment disclosed above, except that the set of clubs has a bounce angle $\Theta_2$ that increases from a negative angle to a positive angle for the amount of loft in the club. Therefore, the long irons that have little loft have a negative bounce angle, the middle irons that have a medium loft do not have a bounce angle, but instead have a bounce surface that is parallel with the ground, and the short irons that have relatively large loft have a positive bounce angle.

For example, in this embodiment, the 1 iron would have a negative 2 degree bounce angle $\Theta_2$, the 2 iron would have a negative 1 degree bounce angle $\Theta_2$ and the 3 iron would have a zero degree bounce angle $\Theta_2$. The other clubs in the set would have the same dimensions as shown in Table I.

Figure 13:
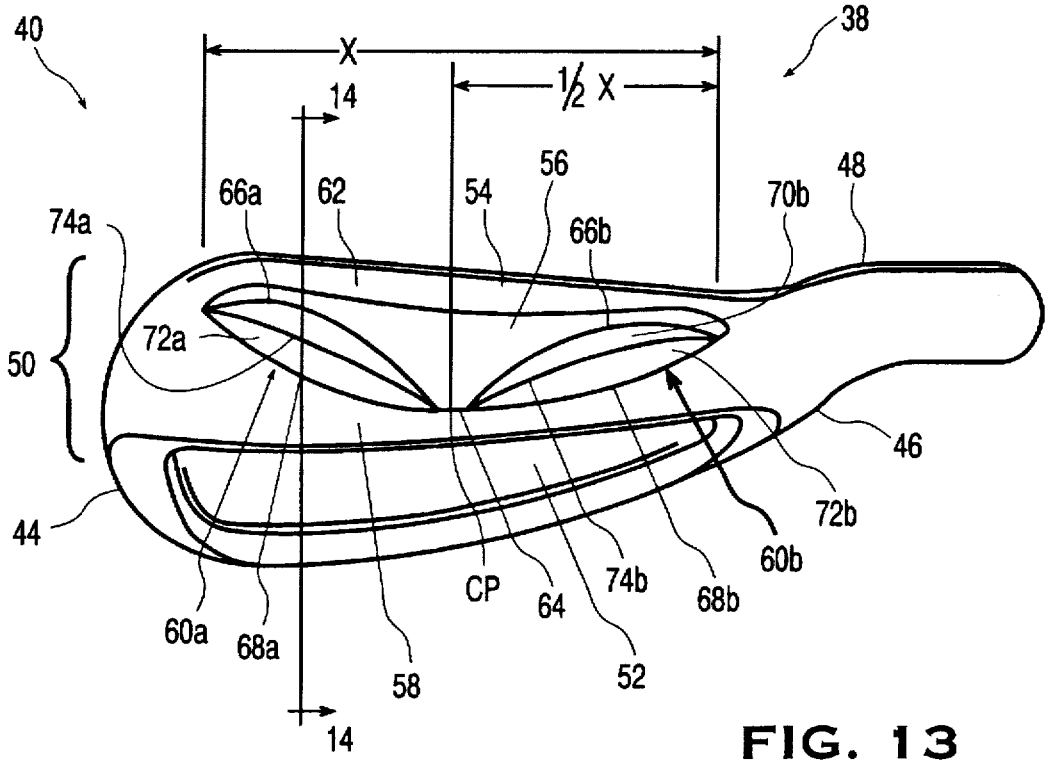
FIG. 13 is an underside view of yet another alternative embodiment of a golf club head of the present invention.
Figure 14:
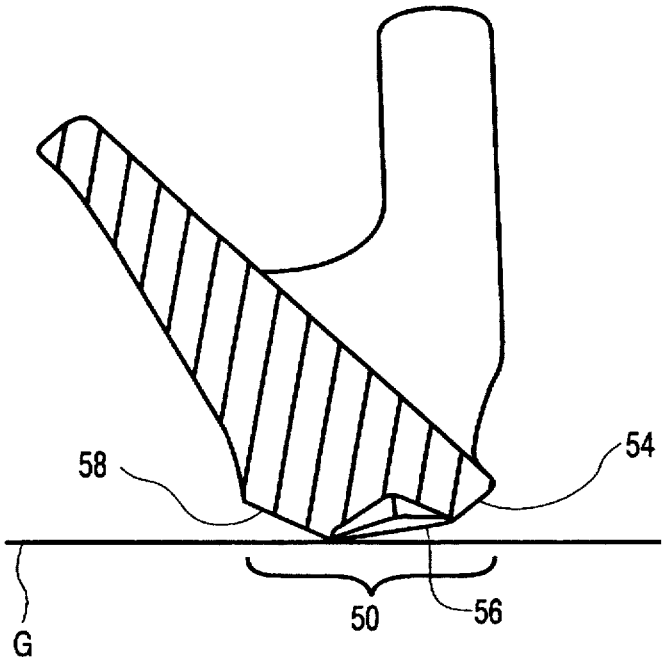
FIG. 14 is a rotated cross-sectional view taken from line 14—14 of FIG. 13.

Referring to FIGS. 13 and 14, another alternative embodiment of a club head 38 of the present invention is shown. The club head 38 is similar to the above described club head, except that the club head 38 has an alternative sole configuration. The club head 38 includes a body 40 with a toe 44, a heel 46, and a sole 50. The sole 50 or flange of the body 40 has three surfaces, an entrance surface 54, a bounce surface 56, and a trailing surface 58. The bounce surface 56 is positioned between the entrance surface 54 and the trailing surface 58.

The bounce surface 56 extends from and connects the entrance surface 54 to the trailing surface 58. A first cavity portion 60*a* is located between the bounce surface 56 and the toe 44 of the club and between the entrance surface 54 and the trailing surface 58. A second cavity portion 60*b* is located between the bounce surface 56 and the heel 46 of the club and between the entrance surface 54 and the trailing surface 58.

The bounce surface 56 is defined by the sole surface angles and the sole cavities 60*a* and 60*b*. The sole surfaces intersect to define an arcuate forward border 62 that is adjacent to and generally parallel to the entrance surface 54.

The sole cavities 60*a* and 60*b* each have a double convex configuration defined by a forward convex border 66*a* and 66*b*, respectively, and opposed by an aft convex border 68*a* and 68*b*, respectively. The aft convex borders 68*a* and 68*b* are aligned to define an aft arcuate border 64, which extends from a forward border 62 to the trailing surface 22. The sole cavities 60*a* and 60*b* are each defined by an arcuate recess 70*a* and 70*b*, respectively, that extends into the club head 38 and a linear plane 72*a* and 72*b*, respectively, that extends into the club head 38. Each arcuate recess 70*a* and 70*b* and each linear plane 72*a* and 72*b* intersect to define an apex 74*a* and 74*b*, respectively, of the cavities 60*a* and 60*b* in the club head 38.

I claim:

1. A golf club iron wherein the iron has a heel, a toe and a striking face having a lower edge therebetween and a sole extending from the heel to the toe, said sole comprising:

a) an entrance surface which is substantially adjacent to the lower edge of the striking face;

b) a trailing surface;

c) a bounce surface positioned between the entrance surface and the trailing surface;

d) a first cavity portion located between the bounce surface and the toe and between the entrance surface and the trailing surface; and e) a second cavity portion located between the bounce surface and the heel and between the entrance surface and the trailing surface;

f) wherein the bounce surface and the trailing surface form an aft arcuate border of the bounce surface, and wherein the bounce surface and the entrance surface form a forward border of the bounce surface.

2. The golf club iron of claim 1 in which the entrance surface has a positive bounce angle.

3. The golf club iron of claim 1 in which the trailing surface has a negative relief angle.

4. The golf club iron of claim 1 in which the bounce surface has a positive bounce surface bounce angle.

5. The golf club iron of claim 4 wherein the bounce surface positive bounce angle is about 22 degrees or less.

6. The golf club iron of claim 1 in which the bounce surface has a positive bounce angle, whereby a lowest point of the iron is on the aft arcuate border.

7. The golf club iron of claim 6 wherein the lowest point of the iron is located at approximately half the distance between the club heel and toe.

8. The golf club iron of claim 6 in which the entrance surface extends from the heel to the toe and wherein the distance from the lower edge of the iron to the lowest point of the iron is between about 0.1 and 0.3 inches.

9. The golf club of claim 6 wherein the bounce surface has a parabolic shape with an apex of the parabolic shape located at the lowest point of the iron on the aft border.

10. The golf club iron of claim 1 in which the entrance surface has a width between about 0.1 and 0.2 inches and has a positive bounce angle.

11. The golf club iron of claim 1 wherein the bounce surface and the entrance surface form a substantially straight forward border of the bounce surface.

12. The golf club iron of claim 1 wherein the bounce surface and the entrance surface form an arcuate forward border of the bounce surface.

13. A set of irons wherein each of the irons has a heel, a toe and a striking face having a lower edge therebetween, and in which one or more of the irons has a sole extending from the heel to the toe, said sole comprising:

a) an entrance surface which is substantially adjacent to the lower edge of the striking face;

b) a trailing surface;

c) a bounce surface positioned between the entrance surface and the trailing surface;

d) a first cavity portion located between the bounce surface and the toe and between the entrance surface and the trailing surface;

e) a second cavity portion located between the bounce surface and the heel and between the entrance surface and the trailing surface; and f) wherein the bounce surface and the trailing surface form an aft arcuate border of the bounce surface and the bounce surface and the entrance surface form a forward border of the bounce surface.

14. A set of golf club irons of claim 13 in which an iron in the set has a leading edge height, as measured from ground at address position of the iron, which is greater than that of another iron in the set.

15. The set of golf club irons of claim 14 in which the leading edge height progressively increases with the loft of the iron through the set.

16. The set of golf club irons of claim 13 in which the entrance surface has a bounce angle and the bounce surface has a bounce angle and wherein the bounce surface bounce angle progressively increases with the loft of the iron through the set.

17. The set of golf club irons of claim 16 wherein the entrance surface bounce angle is equal to or greater than the entrance surface bounce angle for the next iron in the set with less loft.

18. The set of irons of claim 16 wherein the entrance surface balance angle is between 20 and 45 degrees.

19. The set of golf club irons of claim 16 wherein the bounce angle bounce surface is equal to or greater than bounce surface bounce angle for the next iron in the set with less loft.

20. The set of irons of claim 19 wherein the bounce surface bounce angle is between about 0 and 22 degrees.

21. The set of irons of claim 16 wherein the bounce surface bounce angle is between about negative two degrees and 22 degrees.

* * * * *